US007410430B2

(12) United States Patent
Isogawa et al.

(10) Patent No.: US 7,410,430 B2
(45) Date of Patent: Aug. 12, 2008

(54) GOLF BALL

(75) Inventors: Kazuhiko Isogawa, Kobe (JP); Keiji Ohama, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 50 days.

(21) Appl. No.: 11/491,153

(22) Filed: Jul. 24, 2006

(65) Prior Publication Data

US 2007/0026972 A1 Feb. 1, 2007

(30) Foreign Application Priority Data

Jul. 27, 2005 (JP) ..... 2005-218042
Jul. 27, 2005 (JP) ..... 2005-218043

(51) Int. Cl.
*A63B 37/06* (2006.01)

(52) U.S. Cl. ..... 473/378

(58) Field of Classification Search ..... 473/378, 473/373, 377

See application file for complete search history.

(56) References Cited

U.S. PATENT DOCUMENTS 5,902,192 A 5/1999 Kashiwagi et al.
5,935,021 A * 8/1999 Kashiwagi et al. ..... 473/365
2007/0049421 A1* 3/2007 Ohama et al. ..... 473/371
2007/0173350 A1* 7/2007 Ohama et al. ..... 473/371

FOREIGN PATENT DOCUMENTS

JP 60-53164 A 3/1985
JP 10-137365 A 5/1998
JP 10-179799 A 7/1998

* cited by examiner

*Primary Examiner*—Raeann Trimiew
(74) *Attorney, Agent, or Firm*—Birch, Stewart, Kolasch & Birch, LLP

(57) ABSTRACT

The present invention provides a golf ball comprising a core and a cover covering the core, wherein the cover layer comprises a 3-dimensional shaped metal oxide having at least three needle-shaped parts. Blending the 3-dimensional shaped metal oxide into the cover layer enhances the rigidity of the resultant cover for the hardness thereof. In the case that the cover layer has the slab hardness of 57D or more in shore D hardness, this property can be used to enhance the resilience without lowering the shot feeling. On the other hand, in the case that the cover layer has the slab hardness less than 57D in shore D hardness, this property can be used to enhance the resilience without lowering the spin rate.

15 Claims, 5 Drawing Sheets

GOLF BALL

BACKGROUND OF THE INVENTION

1. Field of the Invention

The present invention relates to a golf ball, more particularly to a technique which improves the cover of the golf ball.

2. Description of the Related Art

The resilience (flight distance), durability, shot feeling, control, abrasion resistance are required for golf balls, and the various fillers are added into portions constituting the golf ball body to improve the above requirements.

For example, Japanese patent publication No. S60-53164A discloses a solid golf ball having a high resilience and improved flight performance. The solid golf ball comprises a core and a cover covering the core. The core is made from polymer blends having the gravity of not more than 1.30 in the case of the small sized golf ball, or from polymer blends having the gravity of not more than 1.5 in the case of the large sized golf ball. In addition, the cover is formed to have the gravity of not less than 1.0, or a weight ball is placed in the center of the core. Japanese patent publication No. H10-137365 discloses a golf ball comprises a cover. In the golf ball having the cover made from the cover material including a thermoplastic resin or a thermoplastic elastomer as a main component, the filamental aluminum borate whisker is formulated into the cover material. Japanese patent publication No. H10-179799 discloses a golf ball having a core comprising a thermoplastic resin or a thermoplastic elastomer, wherein the filamental aluminum borate whisker is formulated into the core.

SUMMARY OF THE INVENTION

The major object of adding a filler in a powder shape (granular shape) into the cover layer is to adjust the gravity of the whole golf ball and thus the cover property is not improved well. On the other hand, if the filamental whisker is used for the cover layer, the filamental whisker is oriented along a flow direction of the resin component at the injection molding of the cover, and the anisotropy will generate in the obtained cover. As a result, the durability of the golf ball is not improved well.

Further, the flight distance is required for the golf ball when hitting the golf ball with a driver, but in a conventional method of enhancing the rigidity of the cover to increase the flight distance, the controllability of the golf ball is deteriorated because it is difficult to give spin to the golf ball with approach shots using short irons due to the hardness of the cover.

The present invention has been achieved in view of the above circumstances and is directed to the golf ball having the improved properties. The present invention provides a golf ball comprising a core and a cover layer covering the core, wherein the cover layer comprises a 3-dimensional shaped metal oxide having at least three needle-shaped parts. Since the metal oxide used in the present invention has 3-dimensional shape with at least three needle-shaped parts, the orientation along the flow direction of the resin component at the injection molding of the cover is suppressed. As a result, the anisotropy of the resultant cover is lowered and thus the durability of the golf ball is improved.

Further, blending the 3-dimensional shaped metal oxide into the cover layer enhances the rigidity of the resultant cover for the hardness thereof. This property can be applied to design the golf balls which have different properties that are required for the golf balls. For example, in the case that the cover layer has the slab hardness of 57D or more in shore D hardness, this property can be used to enhance the resilience without lowering the shot feeling. Thus, the golf ball excellent in the durability and the flight performance is obtained without lowering the shot feeling. On the other hand, in the case that the cover layer has the slab hardness less than 57D in shore D hardness, this property can be used to enhance the resilience without lowering the spin rate. Thus, the golf ball excellent in the durability, the flight performance for the driver, and the controllability for short irons is obtained. Especially, the golf ball having the higher durability is obtained.

DESCRIPTION OF THE PREFERRED EMBODIMENT

The present invention provides a golf ball comprising a core and a cover layer covering the core, wherein the cover layer comprises a 3-dimensional shaped metal oxide having at least three needle-shaped parts. Hereinafter, "3-dimensional shaped metal oxide having at least three needle-shapes parts" may be referred to as just "3-dimensional shaped metal oxide."

First of all, the 3-dimensional shaped metal oxide will be explained. The metal oxide used in the present invention is not limited, as long as it has at least three needle-shaped parts in the 3-dimensional shape.

Figure 1:
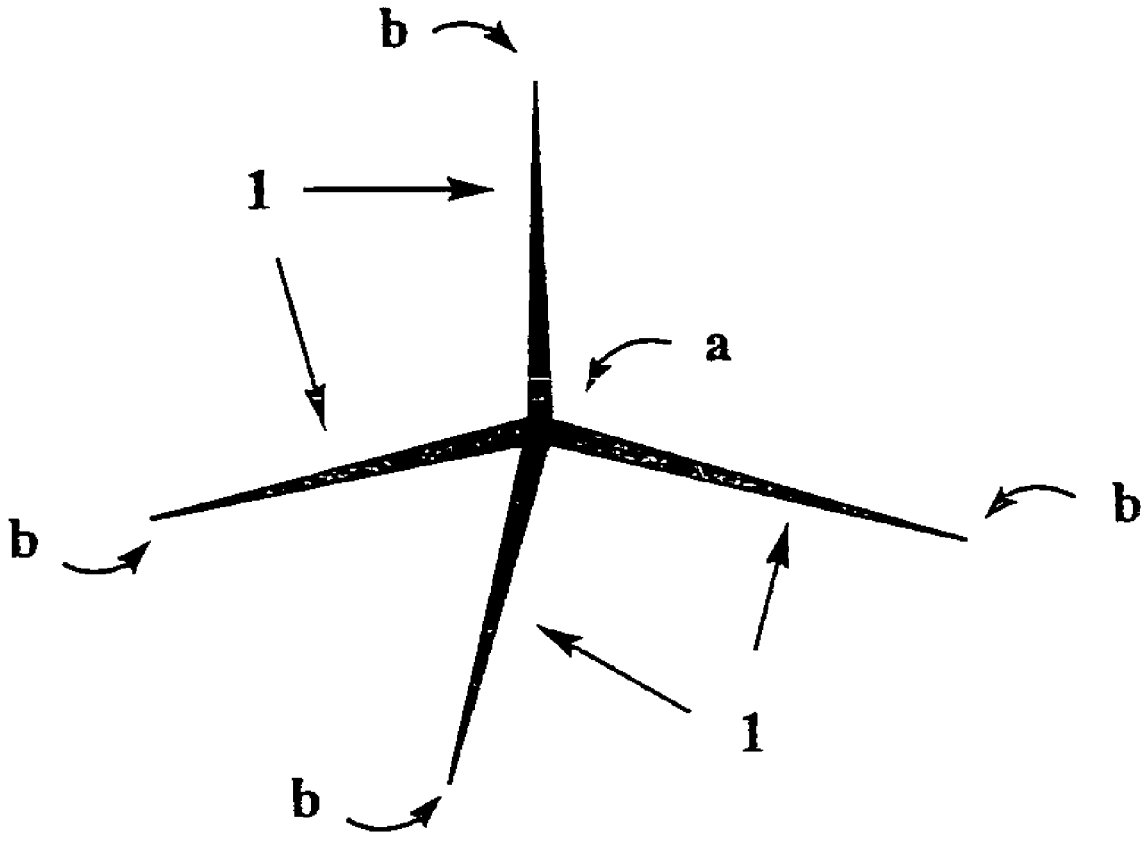
FIG. 1 illustrates an example of the 3-dimensional shaped metal oxide having at least three needle-shaped parts used in the present invention.

For example, in a preferable embodiment, the needle-shaped parts are combined at one end thereof and put the other ends thereof towards the different directions, in a more preferable embodiment, the metal oxide has four needle-shaped parts in the 3-dimensional shape (namely, "tetrapod" shape) where the four needle-shaped parts are combined at the one end thereof at about the center of a regular tetrahedron and put the other ends towards about the corners of the regular tetrahedron, respectively. The needle-shaped part is preferably an acicular crystal of a metal oxide. FIG. 1 illustrates an example of the 3-dimensional shaped metal oxide used in the present invention. Four needle-shaped parts 1 have nearly the same length, and are combined at the one end a thereof at about the center of a regular tetrahedron, and put the other ends b thereof towards about the corners of the regular tetrahedron.

The metal oxide has the needle-shaped parts with the average length of preferably 5 μm or more, more preferably 7 μm or more, and with the average length of preferably 50 μm or less, more preferably 40 μm or less. If the average length is less than 5 μm, the desired rigidity may not be obtained, while if the average length is more than 50 μm, the dispersibility of the 3-dimensional shaped metal oxide into the cover layer may be deteriorated. The needle-shaped part, without limitation, preferably has an average diameter of from 0.2 μm to 3 μm.

Examples of the metal oxide constituting the 3-dimensional shaped metal oxide include zinc oxide, titanium oxide, barium sulfate, and talc. Zinc oxide is a preferable metal oxide. Specific example of the 3-dimensional shaped metal oxide used in the present invention is "zinc oxide whisker in a tetrapod shape, commercial name of 'Pana-Tetra'" available from Matsushita electronic Industrial Co., Ltd.

In the present invention, the cover layer preferably contains the 3-dimensional shaped metal oxide in an amount of 0.3 part or more, more preferably 0.5 part or more, even more preferably 5 parts or more, and in an amount of 25 parts or less, more preferably 20 parts or less, even more preferably 15 parts or less, by mass with respect to 100 parts of the base resin component. Containing the 3-dimensional shaped metal oxide in an amount of 0.3 part or more enhances the rigidity of the resultant cover. On the other hand, containing the 3-dimensional shaped metal oxide in an amount of 25 parts or less enhances the dispersibility of the 3-dimensional shaped metal oxide into the cover layer and thus the durability of the resultant cover is improved.

The present invention has no limitation on a base resin component constituting the cover layer. Examples of the base resin components are polyurethane, an ionomer resin, polyamide, polyester and a mixture thereof. The base resin preferably contains the polyurethane or the ionomer resin as a main component thereof. The base resin preferably contains the polyurethane or the ionomer resin in an amount of 50 mass % or more, more preferably 70 mass % or more, even more preferably 90 mass % or more. In addition, the base resin may essentially consist of the polyurethane or the ionomer resin. The use of the polyurethane or the ionomer resin as the main component of the cover layer provides the cover excellent in the shot feeling and the durability.

As the polyurethane used as the base resin component of the cover, the polyurethane has no limitation, as long as it has a plurality of urethane bonds in the molecule thereof. The polyurethane is, for example, a reaction product obtainable by reacting a polyisocyanate with a polyol, if necessary, by further reacting with a polyamine. The polyurethane includes a thermoplastic polyurethane and a thermosetting (two component curing type) polyurethane.

The polyurethane, generally contains a polyisocyanate component, a polyol component, where necessary a polyamine component. The polyisocyanate component may include any polyisocyanate, as long as it has at least two isocyanate groups. Examples of the polyisocyanate component are an aromatic polyisocyanate such as 2,4-tolylene diisocyanate, 2,6-tolylene diisocyanate, or a mixture thereof (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethyl xylylene diisocyanate (TMXDI), and paraphenylene diisocyanate (PPDI); and an alicyclic or aliphatic polyisocyanate such as 4,4'-dicyclohexylmethane diisocyanate ($H_{12}$MDI), hydrogenated xylylene diisocyanate ($H_6$XDI), hexamethylene diisocyanate (HDI), and isophorone diisocyanate (IPDI). These may be used either alone or as a mixture of at least two of them.

In order to improve the abrasion resistance, it is preferable to use the aromatic polyisocyanate as the polyisocyanate component of the polyurethane. The use of the aromatic polyisocyanate improves the mechanical properties of the resultant polyurethane and thus provides the cover with the excellent abrasion resistance. In view of improving the weather resistance, non-yellowing polyisocyanate (TMXDI, XDI, $HD_1$, $H_6$XDI, IPDI $H_{12}$MDI) are preferably used and 4,4'-dicyclohexylmethane diisocyanate ($H_{12}$MDI) is more preferably used. Since 4,4'-dicyclohexylmethane diisocyanate ($H_{12}$MDI) has a rigid structure, the mechanical property of the resultant polyurethane is improved, and thus the cover excellent in the abrasion resistance is obtained.

The polyol constituting the polyurethane may have either low-molecular-weight or high-molecular-weight, as long as it has a plurality of hydroxyl groups. Examples of the low-molecular-weight polyols are a diol such as ethylene glycol, diethylene glycol, triethylene glycol, 1,3-butanediol, 1,4-butanediol, neopentyl glycol, and 1,6-hexanediol; and a triol such as glycerin, trimethylolpropane, and hexanetriol. Examples of the high-molecular-weight polyols are a polyetherpolyol such as polyoxyethylene glycol (PEG), polyoxypropylene glycol (PPG), and polyoxytetramethylene glycol (PTMG); a condensed polyesterpolyol such as polyethylene adipate (PEA), polybutylene adipate (PBA), and polyhexamethylene adipate (PHMA); a lactone polyesterpolyol such as poly-ε-caprolactone (PCL); a polycarbonatepolyol such as polyhexamethylenecarbonate polyol; and an acrylic polyol. These polyols may be used individually or as a mixture of at least two of them.

The high-molecular-weight polyol preferably has, without limitation, the average molecular weight of 400 or more, more preferably 1,000 or more. If the molecular weight of the high-molecular weight polyol is too small, the resultant polyurethane becomes too hard, and thus the shot feeling of the golf ball becomes bad. The high-molecular-weight polyol has no limitation on the upper limit of the average molecular weight, but the high-molecular-weight polyol preferably has the average molecular weight of 10,000 or less, more preferably 8,000 or less.

The polyamine that constitutes the polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine.

The aromatic polyamine used in the present invention has no limitation, as long as it has at least two amino groups directly or indirectly bonded to an aromatic ring. Herein, the "indirectly bonded to the aromatic ring", for example, means that the amino group is bonded to the aromatic ring through a lower alkylene bond. Further, the aromatic polyamine may include a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine are a type such as phenylenediamine, toluenediamine, diethyltoluenediamine, or dimethylthiotoluenediamine where amino groups are directly bonded to an aromatic ring; and a type such as xylylenediamine where amino groups are bonded to an aromatic ring through a lower alkylene group. The polycyclic aromatic polyamine may include polyaminobenzene having at least two aminophenyl groups directly bonded to each other or a compound having two aminophenyl groups bonded to each other through a lower alkylene group or an alkylene oxide group. Among them, diaminodiphenylalkane having two aminophenyl groups bonded to each other through a lower alkylene group is preferable. Typically preferred are 4,4'-diaminodiphenylmethane and derivatives thereof.

The thermoplastic polyurethane and thermosetting polyurethane (two-component curing type polyurethane) used as the base resin component constituting the cover can be prepared by appropriately combining the polyisocyanate, polyol and polyamine. As a method of preparing the polyurethane, a one-shot method or a prepolymer method can be employed.

The one-shot method is the method where a reaction between the polyisocyanate and the polyol is conducted at one time, while the prepolymer method is the method where the reaction between the polyisocyanate and the polyol is conducted stepwise. For example, the urethane prepolymer having a low-molecular weight is synthesized once, and then polymerized to higher molecular weight in the prepolymer method.

The thermoplastic polyurethane is a polyurethane having a relatively high molecular weight, which is generally prepared by the above method, but the thermosetting polyurethane is prepared by formulating the chain extender (or a curing agent) into the low-molecular weight urethaneprepolymer laid aside followed by carrying out the polymerization to the higher molecular weight when molding the cover.

For the preparation of the polyurethane, a conventional catalyst can be used. Examples of the catalyst are a monoamine such as triethylamine and N,N-dimethylcyclohexylamine; a polyamine such as N,N,N',N'-tetramethylethylenediamine and N,N,N',N'',N''-pentamethyldiethylenetriamine; a cyclicdiamine such as 1,8-diazabicyclo[5,4,0]-7-undecene (DBU) and triethylenediamine; and a tin catalyst such as dibutyltin dilaurylate and dibutyltin diacetate.

In the present invention, the thermoplastic polyurethane is preferably used, and the thermoplastic polyurethane elastomer is more preferably used as the base resin component of the cover layer. The thermoplastic polyurethane elastomer used herein is the polyurethane having so-called "rubber elasticity." The use of the thermoplastic polyurethane elastomer provides the cover with the high resilience. The thermoplastic polyurethane elastomer is not limited, as long as it can be molded into the cover by injection-molding or compression molding. Examples of the thermoplastic polyurethane elastomer are "ELASTOLLAN XNY 90A", "ELASTOLLAN XNY 97A", and "ELASTOLLAN XNY585" available from BASF POLYURETHANE ELASTOMERS.

The thermoplastic polyurethane and the thermoplastic polyurethane elastomer have no limitation on the constitutional embodiments thereof. Examples of the constitutional embodiments are the embodiment where the polyurethane is composed of the polyisocyanate component and the high-molecular weight polyol; the embodiment where the polyurethane is composed of the polyisocyanate component, the high-molecular weight polyol and the low-molecular weight polyol; and the embodiment where the polyurethane is composed of the polyisocyanate component, the high-molecular weight polyol, the low-molecular weight polyol, and the polyamine; and the embodiment where the polyurethane is composed of the polyisocyanate component, the high-molecular weight polyol and the polyamine.

In one preferred embodiment of the present invention, the thermosetting polyurethane is used as the base resin component of the cover layer. The thermosetting polyurethane generates many three dimensional crosslinking points, and thus the cover excellent in durability is obtained. The thermosetting polyurethane includes, for example, a type where the isocyanate group terminated urethane prepolymer is cured with a curing agent such as a polyamine and a polyol and a type where the hydroxyl group or amino group terminated urethane prepolymer is cured with a curing agent such as a polyisocyanate.

The polyamine, polyol and the polyisocyanate used as the curing agent can be appropriately selected from the examples mentioned above.

Among them, it is preferable to use a thermosetting polyurethane which is obtained by curing the isocyanate-group terminated urethaneprepolymer with the polyamine. In this case, the molar ratio of the amino group of the curing agent to the isocyanate group of the urethane prepolymer ($NH_2$/NCO) preferably ranges from 0.70, more preferably from 0.80, even more preferably from 0.85, and preferably to 1.20, more preferably to 1.05, even more preferably to 1.00. If the molar ratio is less than 0.70, the amount of the isocyanate group terminated urethane prepolymer to the polyamine become excess, thus the alophanate or biruet bond tends to generate excessively. The excess alophanate or biruet bond causes the lack of softness of the resultant polyurethane cover. On the other hand, if the molar ratio is more than 1.20, since the isocyanate group is lacking, it becomes difficult to generate the alophanate or biruet bond. As a result, the amount of the three-dimensional crosslinking points becomes too low, resulting in the poor mechanical strength of the resultant thermosetting polyurethane.

In one preferable embodiment, the ionomer resin is used as the base resin component constituting the cover layer. Examples of the ionomer resin are one prepared by neutralizing at least a part of carboxyl groups in a copolymer composed of ethylene and α,β-unsaturated carboxylic acid with a metal ion, and one prepared by neutralizing at least a part of carboxyl groups in a terpolymer composed of ethylene, α,β-unsaturated carboxylic acid and α,β-unsaturated carboxylic acid ester with a metal ion. Examples of the α,β-unsaturated carboxylic acid are acrylic acid, methacrylic acid, fumaric acid, maleic acid, and crotonic acid. Acrylic acid and methacrylic acid are preferable. Examples of the α,β-unsaturated carboxylic acid ester are methyl ester, ethyl ester, propyl ester, n-butyl ester, isobutyl ester and the like of acrylic acid, and methacrylic acid. Especially, the ester of acrylic acid and methacrylic acid are preferable.

The metal ion for neutralizing at least a part of the carboxyl groups includes an alkali metal ion such as sodium, potassium, and lithium; a divalent metal ion such as magnesium, calcium, zinc, barium, and cadmium; a trivalent metal ion such as aluminum, or other metal ions such as tin, and zirconium. Among them, sodium, zinc, and magnesium are preferably used to improve the resilience and the durability.

Specific examples of the ionomer resin are, but not limited to, HIMILAN 1555(Na), HIMILAN 1557(Zn), HIMILAN 1605(Na), HIMILAN 1706(Zn), HIMILAN 1707(Na), HIMILAN AM7311(Mg), and examples of the terpolymer are HIMILAN 1856(Na) and HIMILAN 1855(Zn) available from MITSUI-DUPONT POLYCHEMICAL CO.

Examples of the ionomer resins available from DUPONT CO are SURLYN 8945(Na), SURLYN 9945(Zn), SURLYN 8140(Na), SURLYN 8150(Na), SURLYN 9120(Zn), SURLYN 9150(Zn), SURLYN 6910(Mg), SURLYN 6120(Mg), SURLYN 7930(Li), SURLYN 7940(Li), SURLYN AD8546 (Li), and examples of the terpolymer are SURLYN 8120(Na), SURLYN 8320(Na), SURLYN 9320(Zn), and SURLYN 6320(Mg).

Examples of the ionomer resins available from Exxon Co. are IOTEK 8000(Na), IOTEK 8030(Na), IOTEK 7010(Zn), IOTEK 7030(Zn), and examples of the terpolymer are IOTEK 7510(Zn), and IOTEK 7520(Zn). These ionomers may be used individually or as a mixture of two or more of them. Na, Zn, K, Li, or Mg described in the parentheses after the commercial name of the ionomer resin represent a kind of metal used for neutralization.

The base resin component constituting the cover may further include a thermoplastic elastomer, a diene type block copolymer and the like in addition to the above polyurethane or the ionomer resin. Examples of the thermoplastic elastomer are a polyamide elastomer having a commercial name "PEBAX", for example "PEBAX 2533", available from ARKEMA Inc, a polyester elastomer having a commercial name of "HYTREL", for example "HYTREL 3548", "HYTREL 4047", available from DU PONT-TORAY Co, a polyurethane elastomer having a commercial name "ELASTOLLAN", for example "ELLASTOLLAN ET880" available from BASF POLYURETHANE ELASTOMERS Co, a polystyrene elastomer having a commercial name "Rabalon" available from Mitsubishi Chemical Co. Among them, the thermoplastic polystyrene elastomer is preferable. The thermoplastic polystyrene elastomer includes, for example, a polystyrene-diene block copolymer comprising a polystyrene block component as a hard segment and a diene block component, for example polybutadiene, isoprene, hydrogenated polybutadiene, hydrogenated polyisoprene, as a soft segment. The polystyrene-diene block copolymer comprises a double bond derived from a conjugated diene compound of block copolymer or hydrogenated block copolymer. Examples of the polystyrene-diene block copolymer are a block copolymer having a SBS (styrene-butadiene-styrene) comprising polybutadiene block; and a block copolymer having a SIS (styrene-isoprene-styrene) structure. Specific examples of the diene block copolymer are "Epo friend A1010" available from DAICEL CHEMICAL INDUSTRIES, LTD., and "Septon HG-252" available from KURARAY CO., LTD.

The cover layer of the present invention may further include a pigment such as titanium oxide and a blue pigment; a gravity adjusting agent such as barium sulfate and calcium carbonate; a dispersant, an antioxidant, an ultraviolet absorber, a light stabilizer, a fluorescent material, and a fluorescent brightener in addition to the above base resin component and the 3-dimensional shaped metal oxide, unless they impart any undesirable property to the cover.

In one preferable embodiment of the present invention, the cover layer of the present invention has the slab hardness of 57D or more, more preferably 58D or more, even more preferably 59D or more, and has the slab hardness of 65D or less, more preferably 64D or less in shore D hardness. If the cover layer has the slab hardness of 57D or more in shore D hardness, the rigidity of the obtained golf ball is enhanced and thus the golf ball having the excellent resilience (flight distance) is obtained. On the other hand, if the cover layer has the slab hardness of 65D or less, the shot feeling at the impact of the golf ball is improved. Herein, the slab hardness of the cover layer means a hardness measuring the hardness of the cover layer molded into the sheet (slab) shape. The details of the method to measure the slab hardness is described later. The slab hardness of the cover layer can be adjusted, for example, by appropriately selecting the combination of the base resin components, or the content of the 3-dimensional shaped metal oxide.

In the above preferable embodiment where the cover layer has the slab hardness of 57D or more, the slab hardness X (shore D hardness) and the bending rigidity Y (MPa) of the cover layer satisfy the following equations:

$$57 \leqq X \leqq 65 \quad (1)$$

$$Y \geqq 18X - 850 \text{ (preferably } Y \geqq 18X - 847) \quad (2)$$

In the present invention, blending the 3-dimensional metal shaped oxide into the cover layer enhances the rigidity of the resultant cover for the hardness thereof. This property can be used to enhance the resilience without lowering the shot feeling. The above equations (1) and (2) indicates the relationship that even if the slab hardness X (shore D) of the cover layer falls within the range from 57 to 65 to provide the good shot feeling, the bending rigidity Y becomes high enough to satisfy the equation (2). The equation (2) can be satisfied, for example, by appropriately selecting the combinations of the base resin components, or the contents of the 3-dimensional shaped metal oxide. Preferably, the equation (2) can be satisfied by appropriately adjusting the blending ratio of the polystyrene elastomer to the ionomer resin.

In the above preferable embodiment, the cover layer has a thickness of 2.3 mm or less, more preferably 1.4 mm or less. If the thickness is 2.3 mm or less, since the launch angle of the golf ball becomes appropriate and the flight distance increases in a higher degree. The lower limit of the thickness of the cover layer is for example, but is not limited to, 0.3 mm. Because it is difficult to form the cover layer with the thickness of less than 0.3 mm.

The golf ball of the present invention has no limitation on the structure of the golf ball, as long as it comprises a core layer and a cover layer covering the core layer. The present invention can be applied to any golf ball having the cover layer. The core layer comprises at least one layer, and includes, for example, a single-layered core and a multi-layered core comprising at least two layers. Likewise, the cover layer comprises at least one layer, and includes, for example, a single-layered cover and a multi-layered cover comprising at least two layers. In addition, the golf ball may further comprise at least one intermediate layer between the cover layer comprising at least one layer and the core layer comprising at least one layer. An inner cover layer except the outermost cover of the multi-layered cover and an outer layer except the innermost layer of the multi-layered core can be regarded as the intermediate layer situated between the innermost core layer and the outermost cover layer in the golf ball structure.

In the case that the cover layer of the golf ball is the multi-layered cover composed of at least two layers, at least one layer (preferably the outermost layer) may comprise the above 3-dimensional shaped metal oxide, provided that the slab hardness of the at least one layer satisfies the above range in Shore D hardness and that the slab hardness X (shore D) and the bending rigidity Y (MPa) of the outermost layer of the multi-layered cover layer satisfy the above equations (1) and (2).

In another preferable embodiment of the present invention, the cover layer of the present invention has the slab hardness less than 57D, more preferably 55D or less, even more preferably 52D or less, and has the slab hardness of 35D or more, more preferably 40D or more in shore D hardness. If the cover layer has the slab hardness less than 57D in shore D hardness, since the cover layer becomes soft, the spin rate when hitting the golf ball with a short iron becomes high enough to provide the golf balls with the excellent controllability. On the other hand, if the cover layer has the slab hardness of 35D or more, the resilience of the obtained golf ball becomes high and thus the flight distance increases. Herein, the slab hardness of the cover layer means a hardness measuring the hardness of the cover layer molded into the sheet (slab) shape. The details of the method to measure the slab hardness is described later. The slab hardness of the cover layer can be adjusted, for example, by appropriately selecting the combination of the base resin components, or the content of the 3-dimensional shaped metal oxide.

In the above preferable embodiment where the cover layer has the slab hardness less than 57D, the slab hardness Xc (shore D hardness), the bending rigidity Yc (MPa) of the cover layer, the slab hardness Xr (shore D hardness) and the bending rigidity Yr (MPa) of the base resin component of the cover layer satisfy the following equations:

$$(Yc/Xc)/(Yr/Xr) \geqq 1.05 \quad (1)$$

In the present invention, blending the 3-dimensional shaped metal oxide into the cover layer enhances the rigidity of the resultant cover for the hardness thereof. This property can be used to enhance the resilience without lowering the spin rate. The above equations (1) indicates the relationship that the rigidity of the resultant cover is remarkably high for the hardness thereof by blending the filler into the cover layer, if the equation (1) is satisfied by comparing a ratio of the bending rigidity Yc (MPa) to the slab hardness Xc (shore D) of the cover layer with a ratio of the bending rigidity Yr (MPa) to the slab hardness Xr (shore D) of the base resin component of the cover layer. The equation (1) can be satisfied, for example, by appropriately selecting the combinations of the base resin components, and the contents of the 3-dimensional shaped metal oxide. Preferably, the equation (1) can be satisfied by appropriately adjusting the blending ratio of the polystyrene elastomer to the ionomer resin.

In the above preferable embodiment, the cover layer has a thickness of 2.3 mm or less, more preferably 1.9 mm or less, even more preferably 1.4 mm or less. If the thickness is 2.3 mm or less, since the launch angle of the golf ball becomes appropriate and the flight distance increases in a higher degree. The lower limit of the thickness of the cover layer is for example, but is not limited to, 0.3 mm. Because it may be difficult to form the cover layer with the thickness of less than 0.3 mm.

The golf ball of the above embodiment has no limitation on the structure of the golf ball, as long as it comprises a core layer and a cover layer covering the core layer. The present invention can be applied to any golf ball having the cover layer. The core layer comprises at least one layer, and includes, for example, a single-layered core and a multi-layered core comprising at least two layers. Likewise, the cover layer comprises at least one layer, and includes, for example, a single-layered cover and a multi-layered cover comprising at least two layers. In addition, the golf ball may further comprise at least one intermediate layer between the cover layer comprising at least one layer and the core layer comprising at least one layer. An inner cover layer except the outermost cover of the multi-layered cover and an outer layer except the innermost layer of the multi-layered core can be regarded as the intermediate layer situated between the innermost core layer and the outermost cover layer in the golf ball structure.

In the case that the cover layer of the golf ball is the multi-layered cover comprising at least two layers, at least one layer (preferably the outermost layer) may comprise the above 3-dimensional shaped metal oxide, provided that the slab hardness of the at least one layer satisfies the above range in Shore D hardness and that the slab hardness Xc (shore D), the bending rigidity Yc (MPa) of the at least one layer (preferably the outermost layer), the slab hardness Xr (shore D) and the bending rigidity Yr (MPa) of the base resin component of the cover layer (preferably the outermost layer) satisfy the above equation (1).

Examples of the golf ball of the present inventions are a two-piece golf ball consisting of a core and a cover covering the core, a three-piece golf ball consisting of a core, an intermediate layer covering the core, a cover covering the intermediate layer, a multi-piece golf ball comprising a core, an intermediate layer covering the core, a cover covering the intermediate layer and comprising at least four layers, and a wound-core golf ball.

In the following, the method for preparing the golf ball of the present invention will be explained based on the embodiment of the two-piece golf ball, but the present invention is not limited to the two-piece golf ball and the process explained below.

As the core for the two-piece golf ball, any core which is well-known can be employed. The core of the two-piece golf ball, for example, without limitation, is preferably a molded body which is formed by heat-pressing a rubber composition for the core. The rubber composition for the core comprises, for example, a base rubber, a co-crosslinking agent, a peroxide, a filler, and an antioxidant.

The core is basically formed by heat-pressing a rubber composition for the core that comprising the base rubber, a crosslinking initiator, a co-crosslinking agent, a filler, and an antioxidant. The core has no limitation as long as it contains at least one layer and may have either a single-layered structure or a multi-layered structure of at least two layers. The base rubber preferably includes a natural rubber and/or a synthetic rubber. Examples of the base rubber are butadiene rubber (BR), ethylene-propylene-diene terpolymer (EPDM), isoprene rubber (IR), styrene-butadiene rubber (SBR), and acrylonitrile-butadiene rubber (NBR). Among them, in view of its superior repulsion property, typically preferred is the high cis-polybutadiene rubber having cis-1,4 bond in a proportion of not less than 40%, more preferably not less than 70%, even more preferably not less than 90%.

As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. The amount of the organic peroxide to be blended in the rubber composition is preferably not less than 0.3 part by mass, more preferably not less than 0.4 part by mass, and preferably not more than 5 parts by mass, more preferably not more than 3 parts by mass based on 100 parts by mass of the base rubber. If the content is less than 0.3 part by mass, the core becomes too soft, and the resilience tends to be lowered, and if the content is more than 5 parts by mass, the core becomes too hard and the shot feeling may be lowered.

The co-crosslinking agent used in the present invention includes, for example, an α,β-unsaturated carboxylic acid having 3 to 8 carbon atoms or a metal salt thereof. As the metal forming the metal salt of the α,β-unsaturated carboxylic acid, a monovalent or divalent metal such as zinc, magnesium, calcium, aluminum and sodium is preferably used. Among them, zinc is preferable, because it can impart the higher repulsion property to the golf ball. Specific examples of the α,β-unsaturated carboxylic acid or a metal salt thereof are acrylic acid, methacrylic acid, zinc acrylate, and zinc methacrylate.

In the case that the core has a two-layered structure comprising an inner core and an outer core and the thickness of the outer core is made thin, the zinc salt of α,β-unsaturated carboxylic acid providing the high resilience, especially zinc acrylate is preferable for the inner core layer and the magnesium salt of α,β-unsaturated carboxylic acid providing the good mold-releasing property, especially magnesium methacrylate is preferable for the outer core layer.

The amount of the co-crosslinking agent to be blended in the rubber composition is preferably not less than 10 parts by mass, more preferably not less than 15 parts by mass, even more preferably not less than 20 parts by mass, and preferably not more than 55 parts by mass, more preferably not more than 50 parts by mass, even more preferably not more than 48 parts by mass based on 100 parts by mass of the base rubber. If the content of the co-crosslinking agent is less than 10 parts by mass, the amount of the organic peroxide must be increased to provide the appropriate hardness, and thus the resilience tends to be lowered. On the other hand, if the content of the co-crosslinking agent is more than 55 parts by mass, the core becomes too hard and thus the shot feeling may be lowered.

As the filler, a filler conventionally formulated in the core of the golf ball can be used. The filler includes, for example, an inorganic salt such as zinc oxide, barium sulfate and calcium carbonate, a high gravity metal powder such as tungsten powder, and molybdenum powder and the mixture thereof. The content of the filler is preferably not less than 0.5 part by mass, more preferably not less than 1 part by mass, and is preferably not more than 30 parts by mass, more preferably not more than 20 parts by mass. If the content is less than 0.5 part by mass, it would be difficult to adjust the gravity, while if the content is more than 30 parts by mass, the ratio of the rubber contained in the whole core becomes low and thus the resilience is lowered.

The rubber composition for the core may further include an organic sulfur compound, an antioxidant, or a peptizing agent, as required in addition to the base rubber, the co-crosslinking agent, the crosslinking initiator and the filler. The amount of the antioxidant is not less than 0.1 part and not more than 1 part with respect to 100 parts of the base rubber by mass. The amount of the peptizing agent is not less than 0.1 part and not more than 5 parts with respect to 100 parts of the base rubber by mass.

The core is formed by kneading the above rubber composition and press-molding it into the spherical body in the mold. The conditions for the press-molding should be determined depending on the rubber composition. The press-molding is preferably carried out for 10 to 40 minutes at the temperature of 130 to 180° C. under the pressure of 2.9 MPa to 11.8 MPa.

The core preferably has a diameter of 30 mm or more, more preferably 32 mm or more, and preferably has a diameter of 41 mm or less, more preferably 40.5 mm or less. If the diameter of the core is less than 30 mm, the thickness of the intermediate layer and the cover becomes thicker than the desired thickness and thus the resilience may be lowered. On the other hand, if the diameter of the core is larger than 41 mm, the thickness of the intermediate layer and the cover becomes thinner than the desired thickness and thus the intermediate layer or the cover may not function well.

In the preferable embodiment where the cover layer has the slab hardness of 57 D or more in shore D hardness, the core having a diameter of 30 mm to 41 mm preferably has a compression deformation amount (an amount shrinks along the direction of the compression) of 3.0 mm or more, more preferably 3.4 mm or more and preferably has a compression deformation amount of 6.0 mm or less, more preferably 5.5 mm or less when applying a load from 98 N as an initial load to 1275 N as a final load. If the compression deformation amount is less than 3.0 mm, the shot feeling may become bad due to the hardness, while if the compression deformation amount is larger than 6.0 mm, the resilience may become low.

In the preferable embodiment where the cover layer has the slab hardness less than 57 D in shore D hardness, the core having a diameter of 30 mm to 41 mm preferably has a compression deformation amount (an amount shrinks along the direction of the compression) of 2.0 mm or more, more preferably 2.4 mm or more and preferably has a compression deformation amount of 5.0 mm or less, more preferably 4.5 mm or less when applying a load from 98 N as an initial load to 1275 N as a final load. If the compression deformation amount is less than 2.0 mm, the shot feeling may become bad due to the hardness, while if the compression deformation amount is larger than 5.0 mm, the resilience becomes low.

The present invention can be applied to a wound core golf ball. In that case, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of natural rubber and a synthetic polyisoprene, a sulfur, a vulcanization auxiliary agent, a vulcanization accelerator, and an antioxidant. The rubber thread is wound around the center in elongation of about 10 times length to form the wound core.

When preparing a multi-piece golf ball comprising at least three layers, the same materials described as the base resin component contained in the cover layer can be used for the intermediate layer. Examples of the intermediate layer are a thermoplastic resin such as polyurethane, an ionomer resin, Nylon, and polyethylene; a thermoplastic elastomer such as a polystyrene elastomer, a polyolefin elastomer, a polyurethane elastomer, a polyester elastomer, a polyamide elastomer; and a diene block copolymer. As the intermediate layer, the cured product of the rubber composition can be also used. The intermediate layer may further include a gravity adjusting agent such as barium sulfate and tungsten, an antioxidant and a colorant.

As a method of forming the intermediate layer, typically employed is a method including previously molding the intermediate layer composition into two hemispherical half shells, covering the core together with the two half shells, and subjecting the core with two half shells to the pressure molding, or a method including injection-molding the cover composition directly onto the core to form a cover.

In a process of preparing the golf ball of the present invention, the cover is formed, for example, by covering the core with the cover composition and molding into the cover. Examples of the method of molding the cover are, without limitation, a method including previously molding the cover composition into two hemispherical half shells, covering the core together with the two half shells, and subjecting the core with two half shells to the pressure molding at 130 to 170° C. for 1 to 5 minutes, or a method including injection-molding the cover composition directly onto the core to form a cover.

Further, when forming the cover, the cover can be formed with a multiplicity of concavities, which is so called "dimple", at the surface thereof. As required, the surface of the golf ball can be subjected to grinding treatment such as sandblast in order to improve the adhesion of the mark, or the paint film.

In the preferable embodiment where the cover layer has the slab hardness of 57 D or more in shore D hardness, the golf ball of the present invention, having a diameter of 42.60 mm to 42.90 mm, preferably has a compression deformation amount (an amount shrinks along the direction of the compression) of 2.0 mm or more, more preferably 2.2 mm or more, even more preferably 2.3 mm or more, and preferably has a compression deformation amount of 4.5 mm or less, more preferably 4.3 mm or less, even more preferably 4.0 mm or less when applying a load from 98 N as an initial load to 1275 N as a final load. If the compression deformation amount is less than 2.0 mm, the shot feeling may become bad due to the hardness, while if the compression deformation amount is larger than 4.5 mm, the resilience may become low in some cases.

In the preferable embodiment where the cover layer has the slab hardness of less than 57D in shore D hardness, the golf ball of the present invention, having a diameter of 42.60 mm to 42.90 mm, preferably has a compression deformation amount (an amount shrinks along the direction of the compression) of 1.8 mm or more, more preferably 2.0 mm or more, even more preferably 2.2 mm or more, and preferably has a compression deformation amount of 4.0 mm or less, more preferably 3.6 mm or less, even more preferably 3.2 mm or less when applying a load from 98 N as an initial load to 1275 N as a final load. If the deformation amount is less than 1.8 mm, the shot feeling may become bad due to the hardness, while if the deformation amount is larger than 4.0 mm, the resilience may become low in some cases.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Slab Hardness (Shore D Hardness)

The cover compositions were each formed into sheets each having a thickness of about 2 mm by hot press molding and the resulting sheets were maintained at 23° C. for two weeks. Three or more of the sheets were stacked on one another to avoid being affected by the measuring substrate on which the sheets were placed, and the stack was subjected to the measurement using P1 type auto hardness tester provided with the Shore D type spring hardness tester prescribed by ASTM-D2240, available from KOUBUNSHI KEIKI CO., LTD. For measuring the slab hardness of the base resin component of the cover layer, the cover composition consisting of the base resin component (100 mass parts), titanium dioxide (3 mass parts), and pigment (ultra marine blue 0.1 mass parts) were used to form a sheet.

(2) Bending Rigidity (MPa)

The cover compositions were each formed into sheets each having a thickness of about 2 mm by hot press molding and the resulting sheets were maintained at 23° C. for two weeks. The bending rigidity of the sheet was determined according to JIS-K7106. For measuring the slab hardness of the base resin component of the cover layer, the cover composition consisting of the base resin component (100 mass parts), titanium dioxide (3 mass parts), and pigment (ultra marine blue 0.1 mass parts) were used to form a sheet.

(3) Compression Deformation Amount (mm)

The compression deformation amount (amount shrinks along the compression direction: mm) of the golf balls or the cores was measured when applying a load from 98N (10 kgf) as an initial load to 1275 N (130 kgf) as a final load to the golf balls or the cores.

(4) Durability

Each golf ball was repeatedly hit with a metal head driver (W#1) attached to a swing robot manufactured by TRUETEMPER CO, at the head speed of 45 m/sec to make the golf ball collide with a collision board. Times up to which the golf balls are cracked were measured.

In addition, each value obtained in terms of golf balls No. 1 to No. 13 was reduced to an index number relative to the measured value obtained in Golf ball No. 7 being assumed 100, and each value obtained in terms of golf balls No. 14 to No. 25 was reduced to an index number relative to the measured value obtained in Golf ball No. 20 being assumed 100. The larger number indicates better durability.

(5) Shot Feeling

Actual hitting test was carried out by twenty golfers including professional golfers and high-level amateur golfers (handicap of less than 5) with the driver. The shot feeling was evaluated based on the following criteria. Major result of twenty results was regarded as the shot feeling of the golf ball.

A: Extremely good

B: Good

C: not good

D: Bad (6) Flight Distance (m)

Each golf ball was hit with a metal head driver (XXIO S 10°) attached to a swing robot manufactured by TRUETEMPER CO, at the head speed of 45 m/sec. The flight distance from the hitting point to the point where the golf ball stopped was measured. The measurement was carried out 12 times for each golf ball and the average of 12 times was regarded as the flight distance of the golf ball.

(7) Controllability (Spin Rate:rpm)

Each golf ball was hit with a sand wedge club attached to a swing robot manufactured by Golf Laboratory Co. at the head speed of 21 m/sec, and the spin rate (rpm) was determined by continuously taking a photograph of the spinning golf ball right after hitting the golf ball. The measurement was carried out 5 times for each golf ball and the average of 5 times was regarded as the spin rate of the golf ball.

[Production of the Two-Piece Golf Ball]

(1) Preparation of Solid Core.

The rubber composition shown in Table 1 was kneaded and pressed in upper and lower molds each having a spherical cavity at the heating condition of 170° C. for 20 minutes to obtain the solid core in a spherical shape having a diameter of 39.0 mm to 40.7 mm.

TABLE 1

| Core formulation | Core 1 | Core 2 | Core 3 | Core 4 |
|---|---|---|---|---|
| Polybutadiene rubber | 100 | 100 | 100 | 100 |
| Zinc acrylate | 25 | 26.5 | 32 | 33.5 |
| Zinc oxide | 10 | 10 | 10 | 10 |
| Barium Sulfate | *) | *) | *) | *) |
| Diphenyl disulfide | 0.5 | 0.5 | 0.5 | 0.5 |
| Dicumyl peroxide | 0.8 | 0.8 | 0.8 | 0.8 |
| Diameter (mm) | 39 | 40 | 40.3 | 40.7 |
| Compression Deformation Amount (mm) | — | — | 3.1 | 2.9 |

Formulation: parts by mass

Note on Table 1:

Polybutadiene rubber: BR730 (cis content: 96%) available from JSR Co.

Zinc acrylate: "ZNDA-90S" produced by NIHON JYORYU KOGYO Co,.LTD.

Diphenyl disulfide: Sumitomo Seika Chemicals Company Limited

Zinc oxide: "Ginrei R" produced by Toho-Zinc Co.

Dicumyl peroxide: "Percumyl D" produced by NOF Corporation.

Barium sulfate: Barium sulfate BD available from Sakai Chemical Industry Co., LTD.

The amount of barium sulfate was appropriately adjusted to obtain the golf ball having a mass of 45.4 g in accordance with the cover composition.

(2) Preparation of the Cover Material

The materials shown in Table 2 and Table 3 were mixed using a twin-screw kneading extruder to obtain the cover composition in the form of pellet. The extrusion was conducted in the following conditions:

screw diameter=45 mm,
screw revolutions=200 rpm,
screw L/D=35, and the cover composition was heated to from 160° C. to 230° C. at the die position of the extruder.

TABLE 2

| Cover composition | A | B | C | D | E | F | G | H | I | J | K |
|---|---|---|---|---|---|---|---|---|---|---|---|
| SURLYN 8945 | 45 | 45 | 45 | 45 | 45 | 40 | 45 | 45 | 45 | 45 | 45 |
| SURLYN 9945 | 45 | 45 | 45 | 45 | 45 | 40 | 45 | 45 | 45 | 45 | 45 |
| Rabalon SR04 | 10 | 10 | 10 | 10 | 10 | 20 | 10 | 10 | 10 | 10 | 10 |
| Pana tetra WZ-0501 | 0.3 | 0.5 | 5 | 20 | 25 | 5 | — | — | — | — | — |
| WHITESEAL | — | — | — | — | — | — | — | 5 | — | — | — |
| Alborex YS3A | — | — | — | — | — | — | — | — | 5 | — | — |
| TISMO D-102 | — | — | — | — | — | — | — | — | — | 5 | — |
| Surface strand REV8 | — | — | — | — | — | — | — | — | — | — | 5 |
| Ttanium dioxide | 3 | 3 | 3 | 3 | 3 | 3 | 3 | 3 | 3 | 3 | 3 |
| Urtramarine blue | 0.1 | 0.1 | 0.1 | 0.1 | 0.1 | 0.1 | 0.1 | 0.1 | 0.1 | 0.1 | 0.1 |
| Property | — | — | — | — | — | — | — | — | — | — | — |
| Slab hardness(Shore D): X | 60 | 60 | 60 | 61 | 61 | 56 | 60 | 60 | 62 | 62 | 62 |
| Bending rigidity (MPa): Y | 235 | 237 | 239 | 255 | 260 | 150 | 225 | 232 | 248 | 247 | 249 |
| 18X-850 | 230 | 230 | 230 | 248 | 248 | 158 | 230 | 230 | 266 | 266 | 266 |

Formulation: parts

Notes on Table 2:

SURLYN 8945: an ionomer resin of a sodium ion-neutralized ethylene-methacrylic acid copolymer, available from DUPONT CO.

SURLYN 9945: an ionomer resin of a zinc ion-neutralized ethylene-methacrylic acid copolymer, available from DUPONT CO.

Rabalon SR04: a polystyrene elastomer available from Mitsubishi Chemical Co

Pana Tetra WZ-0501: 3-dimensional shaped metal oxide (zinc oxide) available from Matsushita electronic Industrial Co., Ltd.

WHITESEAL: commercially produced zinc oxide (glandular shape: particle size 344 μm) available from PT. INDO LYSAGHT ALBOREX YS3A: filamental aluminum borate whisker available from Shikoku Chemicals Corp.

TISMO D-102: needle shaped potassium titanate fiber available from Otsuka Chemical Co., Ltd.

Surface strandREV8: glass fiber available from NSG Vetrotex K.K.

TABLE 3

| Cover composition | L | M | N | O | P | Q | R | S | T | U | V | W | X | Y |
|---|---|---|---|---|---|---|---|---|---|---|---|---|---|---|
| HIMILAN 1605 | 40 | 40 | 40 | 40 | 40 | — | 40 | 50 | — | 50 | 40 | 40 | 40 | 40 |
| HIMILAN 1706 | 35 | 35 | 35 | 35 | 35 | — | 35 | 40 | — | 40 | 35 | 35 | 35 | 35 |
| Rabalon T3339C | 25 | 25 | 25 | 25 | 25 | — | 25 | 10 | — | 10 | 25 | 25 | 25 | 25 |
| Elastollan XNY97A | — | — | — | — | — | 80 | — | — | 80 | — | — | — | — | — |
| PEBAX 5533SN00 | — | — | — | — | — | 20 | — | — | 20 | — | — | — | — | — |
| Pana tetra WZ-0501 | 0.3 | 0.5 | 5 | 20 | 25 | 5 | — | — | — | 5 | | — | — | — |
| WHITESEAL | — | — | — | — | — | — | — | — | — | — | 5 | — | — | — |
| ALBOREX YS3A | — | — | — | — | — | — | — | — | — | — | — | 5 | — | — |
| TISMO D-102 | — | — | — | — | — | — | — | — | — | — | — | — | 5 | — |
| Surface strand REV8 | — | — | — | — | — | — | — | — | — | — | — | — | — | 5 |
| Titanium dioxide | 3 | 3 | 3 | 3 | 3 | 3 | 3 | 3 | 3 | 3 | 3 | 3 | 3 | 3 |
| Urtramarine blue | 0.1 | 0.1 | 0.1 | 0.1 | 0.1 | 0.1 | 0.1 | 0.1 | 0.1 | 0.1 | 0.1 | 0.1 | 0.1 | 0.1 |
| Property | — | — | — | — | — | — | — | — | — | — | — | — | — | — |
| Slab hardness (Shore D): Xc | 52 | 52 | 52 | 52 | 53 | 48 | 52 | 59 | 48 | 59 | 52 | 54 | 54 | 54 |
| Bending rigidity (MPa): Yc | 115 | 118 | 119 | 120 | 124 | 54 | 110 | 200 | 49 | 210 | 110 | 119 | 115 | 116 |
| Slab hardness (Shore D): Xr | 52 | 52 | 52 | 52 | 52 | 48 | — | — | — | 59 | 52 | 52 | 52 | 52 |
| Bending rigidity (MPa): Yr | 110 | 110 | 110 | 110 | 110 | 49 | — | — | — | 200 | 110 | 110 | 110 | 110 |
| (Yc/Xc)/(Yr/Xr) | 1.05 | 1.07 | 1.08 | 1.09 | 1.11 | 1.10 | — | — | — | 1.05 | 1.00 | 1.04 | 1.01 | 1.02 |

Formulation: parts

Notes on table 3:

HIMILAN 1605: an ionomer resin of a sodium ion-neutralized ethylene-methacrylic acid copolymer, available from MITSUI-DUPONT POLYCHEMICAL CO., LTD.

HIMILAN 1706: an ionomer resin of a zinc ion-neutralized ethylene-methacrylic acid copolymer, available from MITSUI-DUPONT POLYCHEMICAL CO., LTD.

ELASTOLLAN XNY97A: a H12MDI-PTMG type thermoplastic polyurethane elastomer available from BASF Japan.

Rabalon T3339C: a polystyrene elastomer available from Mitsubishi Chemical Co.

PEBAX 5533SN00: a polyamide elastomer available from ARKEMA Inc.

Pana Tetra WZ-0501: 3-dimensional shaped metal oxide (zinc oxide) available from Matsushita electronic Industrial Co., Ltd.

WHITESEAL: commercially produced zinc oxide (granular shape: particle size 344 μm) available from PT. INDO LYSAGHT ALBOREX YS3A: filamental aluminum borate whisker available from Shikoku Chemicals Corp.

TISMO D-102: needle shaped potassium titanate fiber available from Otsuka Chemical Co., Ltd.

Surface strandREV8: glass fiber available from NSG Vetrotex K.K.

(3) Preparation of the Golf Ball Body

The cover composition thus prepared was directly injection-molded onto the core to form the cover, thereby obtaining the two-piece golf ball body.

The upper and lower molds for forming the cover have a spherical cavity with dimples. The part of the dimples can serve as a hold pin which is retractable. When forming the golf ball body, the hold pins were protruded to hold the core, and the resin heated at 210° C. was charged into the mold held under the pressure of 80 tons for 0.3 seconds. After the cooling for 30 seconds, the molds were opened and then the golf ball body was discharged. The surface of the obtained golf ball was subjected to the sand-blast treatment, and then the mark was printed and the clear paint was coated on the surface of the golf ball respectively. The paint was dried in an oven kept at 40° C. to obtain the golf ball having a diameter of 42.7 mm and a mass of 45.4 g. The golf balls were formed with a dimple pattern shown in Table 4 and FIGS. 2 to 4 at the surface thereof.

TABLE 4

Figure 2:
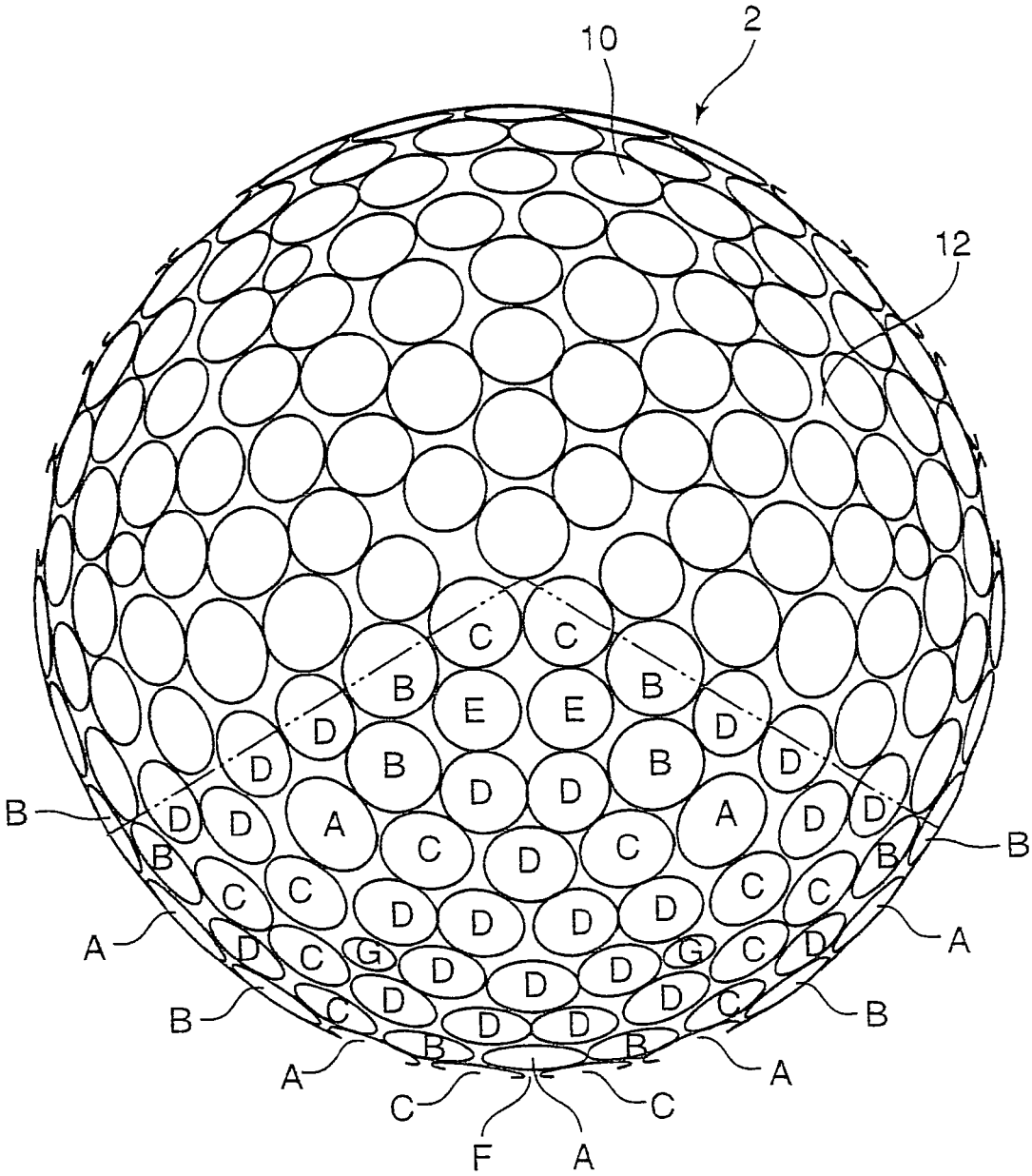
FIG. 2 is a plan view of the golf ball formed with dimples at the surface thereof.
Figure 3:
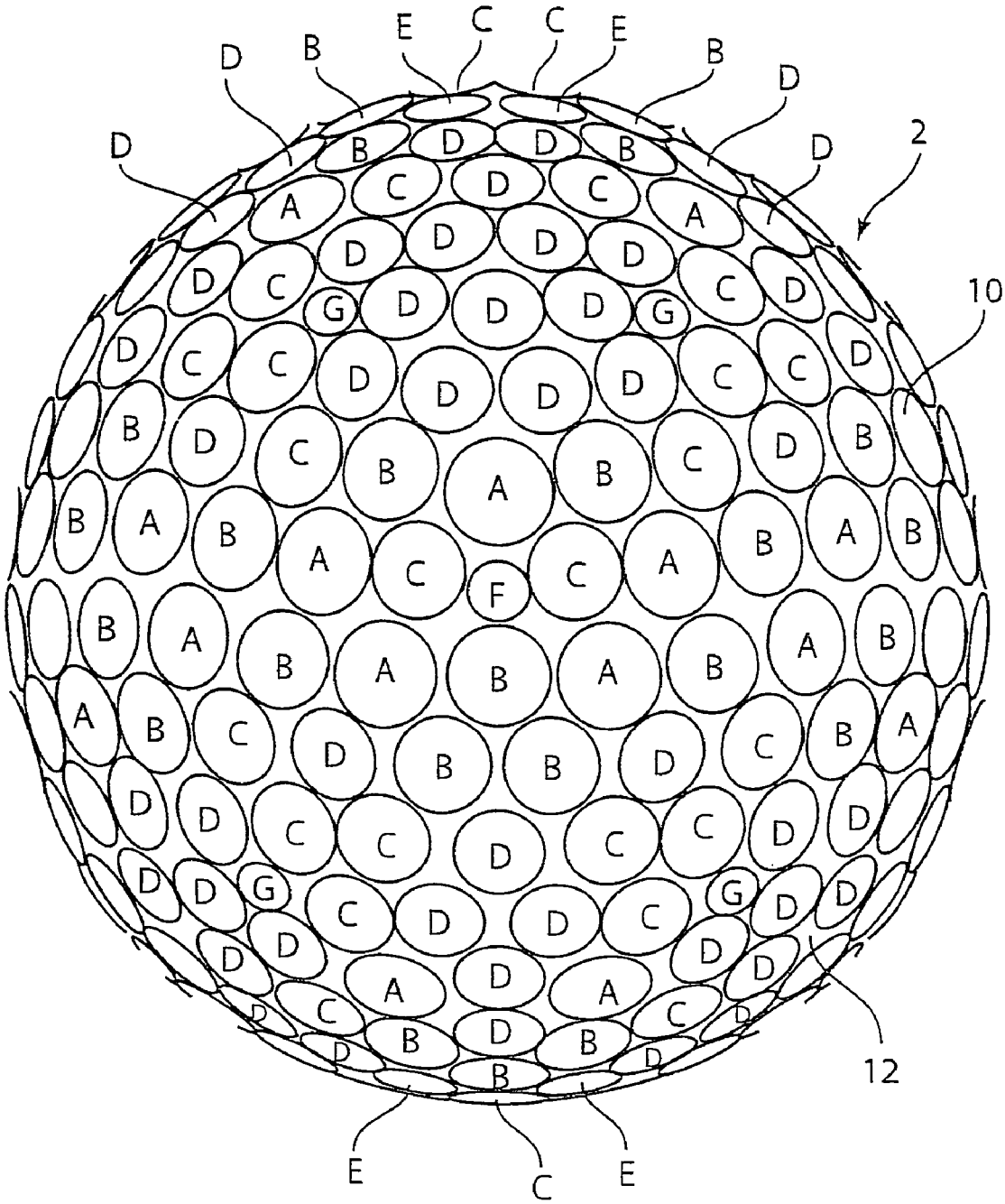
FIG. 3 is a front view of the golf ball formed with dimples at the surface thereof.
Figure 4:
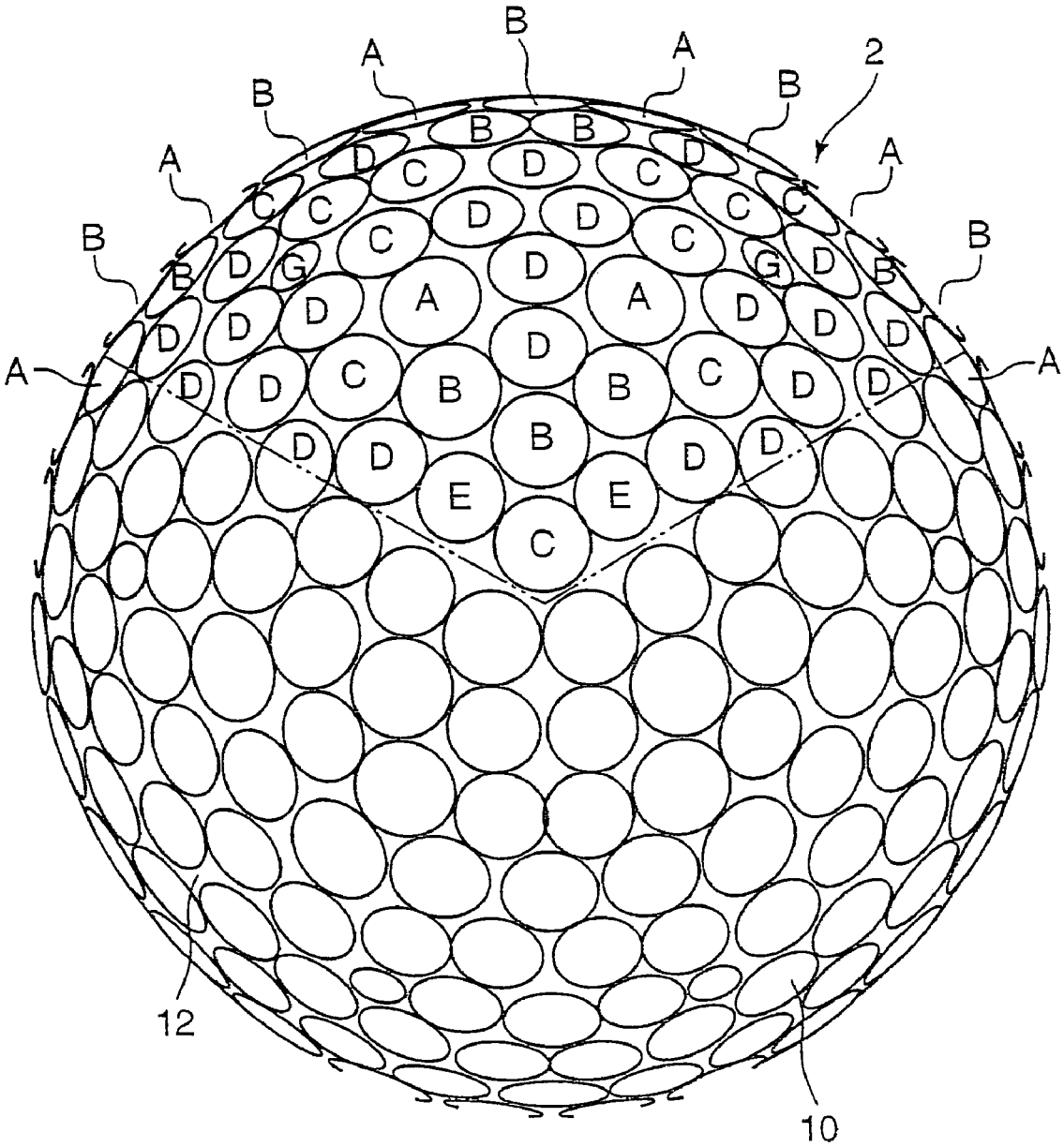
FIG. 4 is a bottom view of the golf ball formed with dimples at the surface thereof.

| Type | Number | Diameter (mm) | Depth (mm) | Volume ($mm^3$) | Plan view | Front view | Bottom view |
|---|---|---|---|---|---|---|---|
| A | 42 | 4.65 | 0.135 | 1.148 | FIG. 2 | FIG. 3 | FIG. 4 |
| B | 66 | 4.45 | 0.134 | 1.043 | | | |
| C | 72 | 4.25 | 0.134 | 0.952 | | | |
| D | 126 | 4.05 | 0.134 | 0.864 | | | |
| E | 12 | 3.95 | 0.133 | 0.816 | | | |
| F | 3 | 2.80 | 0.132 | 0.408 | | | |
| G | 12 | 2.65 | 0.132 | 0.365 | | | |

Figure 5:
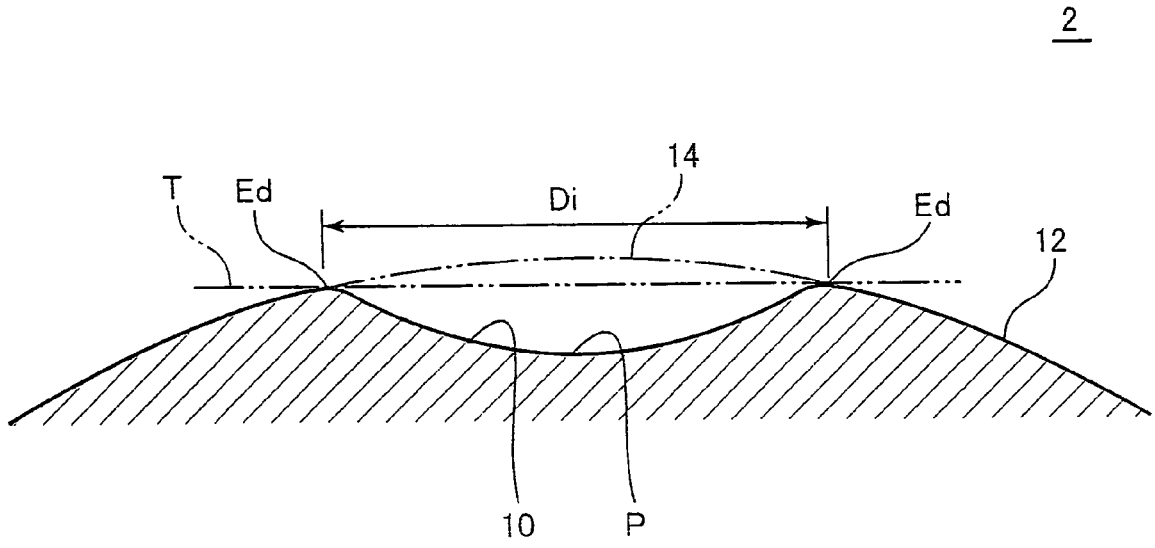
FIG. 5 is an enlarged sectional view of a dimple formed at the surface of the golf ball.

In table 4, "Diameter" of the dimple corresponds to Di, "Depth" represents the distance between the tangential line T and the deepest portion P, and "volume" means the volume enclosed with the plane comprising the outline of dimple 10 and the hypothetical ball 14 in FIG. 5.

The obtained golf balls were evaluated in terms of durability, flight performance (flight distance), controllability (spin rate), and shot feeling. The results were also shown in table 5 and table 6.

The golf balls No. 1 to No. 6 are the golf balls comprising a core and a cover covering the core, wherein the cover layer comprises a 3-dimensional shaped metal oxide having at least three needle-shaped parts and has the slab hardness of 57D or more in Shore D hardness. All of the golf balls were excellent in the durability, flight distance, and shot feeling. The results indicated that the cover layers made from the cover compositions A to E used for the golf balls No. 1 to No. 6 have high bending rigidity for the slab hardness thereof. Golf ball No. 7 is a conventional golf ball of which the cover layer does not contain a filler (reinforcing material). Golf ball No. 8 is the case that the cover layer contains the 3-dimensional shaped metal oxide and has the slab hardness of less than 57. The durability of the golf ball was improved but the flight distance was slightly lowered, if compared with the golf ball No. 7. Golf ball No. 9 is the case that the cover layer contains the granular zinc oxide. The durability and the flight distance were not improved. Golf balls No. 10 to No. 12 are the cases that the cover layer contains the filamental filler (reinforcing material). The flight distances were improved but the durability was lowered.

Golf ball No. 13 is the case of enlarging the core diameter of the core of the golf ball No. 7. The flight distance was improved but the durability was deteriorated because the thickness of the cover became thin.

According to the preferable embodiment where the cover layer has the slab hardness of 57D or more in shore D hardness, it is possible to provide the golf ball that is excellent in the durability and the flight performance (distance) without lowering the shot feeling.

TABLE 5

| | Golf ball No. | | | | | | | | | | | | |
|---|---|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 | No. 12 | No. 13 |
| Type of core | 1 | 1 | 1 | 2 | 1 | 1 | 1 | 1 | 1 | 1 | 1 | 1 | 2 |
| Core diameter(mm) | 39 | 39 | 39 | 40 | 39 | 39 | 39 | 39 | 39 | 39 | 39 | 39 | 40 |
| Core Compression deformation amount(mm) | 3.8 | 3.8 | 3.8 | 3.5 | 3.8 | 3.8 | 3.8 | 3.8 | 3.8 | 3.8 | 3.8 | 3.8 | 3.5 |
| Type of cover | C | A | E | C | B | D | G | F | H | I | J | K | G |
| Cover thickness (mm) | 1.9 | 1.9 | 1.9 | 1.4 | 1.9 | 1.9 | 1.9 | 1.9 | 1.9 | 1.9 | 1.9 | 1.9 | 1.4 |
| Golf ball compression deformation amount(mm) | 3.1 | 3.1 | 3 | 3.1 | 3.1 | 3 | 3.1 | 3.3 | 3.1 | 2.9 | 2.9 | 2.9 | 3.1 |
| Durability (Index number) | 124 | 103 | 102 | 106 | 110 | 108 | 100 | 118 | 100 | 85 | 83 | 80 | 70 |
| Durability (Times) | 136 | 113 | 112 | 117 | 121 | 119 | 110 | 130 | 110 | 94 | 91 | 88 | 77 |
| Flight distance(m) | 245 | 238 | 244 | 255 | 240 | 244 | 235 | 230 | 236 | 240 | 238 | 240 | 245 |
| Shot feeling | A | A | A | A | A | A | A | B | A | C | B | C | A |

TABLE 6

| | Golf ball No. | | | | | | | | | | | |
|---|---|---|---|---|---|---|---|---|---|---|---|---|
| | No. 14 | No. 15 | No. 16 | No. 17 | No. 18 | No. 19 | No. 20 | No. 21 | No. 22 | No. 23 | No. 24 | No. 25 |
| Type of core | 3 | 3 | 3 | 3 | 3 | 4 | 3 | 3 | 3 | 3 | 3 | 3 |
| Core diameter(mm) | 40.3 | 40.3 | 40.3 | 40.3 | 40.3 | 40.7 | 40.3 | 40.3 | 40.3 | 40.3 | 40.3 | 40.3 |
| Type of cover | N | L | M | O | P | Q | R | U | V | W | X | Y |
| Cover thickness(mm) | 1.2 | 1.2 | 1.2 | 1.2 | 1.2 | 1.7 | 1.2 | 1.2 | 1.2 | 1.2 | 1.2 | 1.2 |
| Golf ball compression deformation amount(mm) | 2.8 | 2.8 | 2.8 | 2.8 | 2.8 | 2.7 | 2.8 | 2.6 | 2.8 | 2.7 | 2.7 | 2.7 |
| Durability (Index number) | 115 | 106 | 109 | 112 | 110 | 118 | 100 | 105 | 100 | 90 | 88 | 85 |
| Durability (Times) | 230 | 212 | 218 | 224 | 220 | 236 | 200 | 210 | 200 | 180 | 176 | 170 |
| Flight distance(m) | 232 | 231 | 232 | 232 | 232 | 233 | 228 | 234 | 228 | 229 | 230 | 228 |
| Controllability (spin rate: rpm) | 6500 | 6400 | 6400 | 6500 | 6400 | 6800 | 6400 | 5800 | 6400 | 6300 | 6400 | 6300 |

The golf balls No. 14 to No. 19 are the golf balls comprising a core and a cover covering the core, wherein the cover layer comprises a 3-dimensional shaped metal oxide having at least three needle-shaped parts and has the slab hardness of less than 57D in Shore D hardness. All of the golf balls were excellent in the durability, flight distance, and controllability. The cover compositions L to Q used for the golf balls No. 14 to No. 19 satisfy the equation: $(Yc/Xc)/(Yr/Xr) \geqq 1.05$ and thus have high bending rigidity for the slab hardness thereof. Golf ball No. 20 is a conventional golf ball of which the cover layer does not contain a filler (reinforcing material). Golf ball No. 21 is the case that the cover layer contains the 3-dimensional shaped metal oxide and has the slab hardness of 57 or more. The durability of the golf ball was improved but the controllability (spin rate) with the short iron was lowered, if compared with the golf ball No. 20. Golf ball No. 22 is the case that the cover layer contains the granular zinc oxide. The durability, the flight distance and the controllability were not improved. Golf balls No. 23 to No. 25 are the cases that the cover layer contains the filamental filler (reinforcing material). The durability, the flight distance and the controllability were not improved so much.

According to the preferable embodiment where the cover layer has the slab hardness of less than 57D, it is possible to provide the golf ball that is excellent in the durability, the flight performance (distance) of the driver shot, and the controllability (spin rate) of the short iron. Especially, the durability is improved in a remarkable degree.

In recent years, the golf ball having the structure with the thin cover layer has been studied in order to provide the longer flight distance. The present invention provides the golf ball with excellent properties, even if the golf ball has the thin cover layer.

This application is based on Japanese Patent application No.2,005-218,042 and No.2,005-218,043 filed on Jul. 27, 2005, the contents of which are hereby incorporated by reference.

What is claimed is:

1. A golf ball comprising;

a core; and a cover layer covering the core, wherein the cover layer comprises a 3-dimensional shaped metal oxide having at least three needle-shaped parts.

2. The golf ball according to claim 1, wherein the 3-dimensional shaped metal oxide has a 3-dimensional shape where the at least three needle-shaped parts are combined with each other at one end thereof and the other ends thereof are put towards different directions, respectively.

3. The golf ball according to claim 1, wherein the metal oxide has four needle-shaped parts and has a 3-dimentional shape where the four needle-shaped parts are combined at one end thereof at about a center of a regular tetrahedron and the other ends thereof are put towards about ihe corners of the regular tetrahedron, respectively.

4. The golf ball according to claim 1, wherein the metal oxide has the needle-shaped parts with an average length of from 5 μm to 50 μm.

5. The golf ball according to claim 1, wherein the metal oxide is zinc oxide.

6. A golf ball comprising;

a core; and a cover layer covering the core, wherein the cover layer comprises a 3-dimensional shaped metal oxide having at least three needle-shaped parts and has a slab hardness of less than 57 D in shore D hardness.

7. The golf ball according to claim 6, wherein the 3-dimensional shaped metal oxide has a .3-dimensional shape where the at least three needle-shaped parts are combined with each other at one end thereof and the other ends thereof are put towards different directions, respectively.

8. The golf ball according to claim 6, wherein the metal oxide has four needle-shaped parts and has a 3-dimentional shape where the four needle-shaped parts are combined at one end thereof at about a center of a regular tetrahedron and the other ends thereof are put towards about the corners of the regular tetrahedron, respectively.

9. The golf ball according to claim 6, wherein the metal oxide has the needle-shaped parts with an average length of from 5 μm to 50 μm.

10. The golf ball according to claim 6, wherein the metal oxide is zinc oxide.

11. A golfball comprising:

a core; and a cover layer covering the core, wherein the cover layer comprises a 3-dimensional shaped metal oxide having at least three needle-shaped parts and has a slab hardness of 57D or more in shore D hardness.

12. The golf ball according to claim 11, wherein the 3-dimensional shaped metal oxide has a 3-dimensional shape where the at least three needle-shaped parts are combined with each other at one end thereof and the other ends thereof are put towards different directions, respectively.

13. The golf ball according to claim 11, wherein the metal oxide has four needle-shaped parts and has a 3-dimentional shape where the four needle-shaped parts are combined at one end thereof at about a center of a regular tetrahedron and the other ends thereof are put towards about the corners of the regular tetrahedron, respectively.

14. The golf ball according to claim 11, wherein the metal oxide has the needle-shaped parts with an average length of from 5 μm to 50 μm.

15. The golf ball according to claim 11, wherein the metal oxide is zinc oxide.

* * * * *